United States Patent [19]

Cole

[11] 4,016,631

[45] Apr. 12, 1977

[54] APPARATUS AND METHOD FOR TRAVERSING A STRAND

[76] Inventor: Paul Morrison Cole, 1213 Hillside Blvd., Carrcroft, Wilmington, Del. 19803

[22] Filed: Feb. 10, 1976

[21] Appl. No.: 656,975

[52] U.S. Cl. ..... 28/1 CL; 28/72 NW; 156/439

[51] Int. Cl.[2] ..... D04H 3/05

[58] Field of Search ..... 28/1 CL, 72 R, 72 NW; 156/439, 440

[56] References Cited

UNITED STATES PATENTS

| | | | |
|---|---|---|---|
| 3,340,584 | 9/1967 | Kalwaites | 28/1 CL |
| 3,422,511 | 6/1969 | Seguin | 28/1 CL |
| 3,602,965 | 9/1971 | Burger | 28/1 CL |
| 3,805,341 | 4/1974 | Jense | 28/1 CL |
| 3,921,265 | 11/1975 | Eschenbach | 28/1 CL |

*Primary Examiner*—Louis K. Rimrodt

[57] ABSTRACT

A method of traversing a strand between two spaced rows of strand-restraining elements moving together in the same direction to form a web is carried out by a strand-engaging member that orbits each row to alternately traverse the strand toward one and then the other row while forming a loop in the strand during each traverse and positioning the loop around at least one strand-restraining element. Rotary means traveling in the same instantaneous direction as the loop release it from the strand-engaging member.

24 Claims, 15 Drawing Figures

APPARATUS AND METHOD FOR TRAVERSING A STRAND

BACKGROUND OF THE INVENTION

This invention relates to a method and apparatus for traversing one or more strands at high speed to form continuous restrained webs having transverse strands in a variety of patterns. More particularly, it relates to a method suited to forming restrained webs of orthogonal pattern in a more positive manner and without the tendency to strand abuse associated with prior high speed equipment.

Products, such as paper and nonwoven fabric, frequently are reinforced with one set of strands in the long direction of the web and a second set in the transverse direction. Maximum efficiency and product uniformity dictate that the strands be spaced equally and of identical length to assume equal sharing of applied loads. Webs of transverse strands held by pins or other selvage restraining elements on a conveyor can be treated readily and combined with a machine direction warp of strands or a sheet of paper like material, the assembly being bonded together with adhesives or other means.

Many prior devices have utilized reciprocating mechanisms that are severely speed limited. Some employ strand carriers that pass between selvage pins, requiring wide spacing of the pins and precluding close spacing of the transverse strands. Others carry the strands over the tops of the pins and require a separate high speed action across the strands to deposit them around the pins. Such sudden action across the strands tends to damage them and lose control of the positioning, particularly when the same action serves also to discharge the strands from the carrier.

Prior machines for traversing strands to form webs have required considerable space beyond the width of the web. The strand traversing equipment, generally, is a component of a long processing line, so that the added width results in wasted space throughout the remainder of the production line.

My present invention has as an objective the achievement of high speed through the traversing of strands with a mechanism using nothing but continuous rotary motion, and the positioning of the strands around closely spaced selvage restraining elements while the strands are fully controlled and without a separate depositing action. An additional objective is to provide a means of high speed strand traversing that minimizes strand abuse. A further objective is to provide a traversing machine that minimizes space requirements beyond the web width.

Though the term "strands" will be used throughout the specifications, this term is meant to include yarns, threads, cords, filaments and other similar materials. Such materials may be either natural or synthetic.

SUMMARY OF THE INVENTION

In accordance with my present invention, the traversing of strands to form a web is carried out with two counter-rotated members, each of which has strand-engaging extremities that orbit one of two selvage conveyors carrying strand-restraining elements at the same speed in the same general direction. An orbiting extremity with slideable engagement draws the strand as a loop from a supply through a guide between the conveyors and positions the loop around one or more of the strand-restraining elements. The loop is then released to the strand-restraining elements by a continuously rotating member that moves in the same general direction as the orbiting extremity at the time of the release so as to minimize strain on the strand. Loops are alternately carried in this manner to opposite conveyors by the opposite orbiting extremities.

The orbiting extremities are designed to make the strand take the desired loop form and oreintation by providing a track on each extremity in which this loop form is the shortest strand path. All operations, with the exception of the release, are performed by the orbiting extremities. The positioning around the strand-restraining elements is carried out before the release is initiated.

BRIEF DESCRIPTION OF THE ILLUSTRATED EMBODIMENTS

DETAILED DESCRIPTION OF THE ILLUSTRATED IMBODIMENTS

Figure 1:
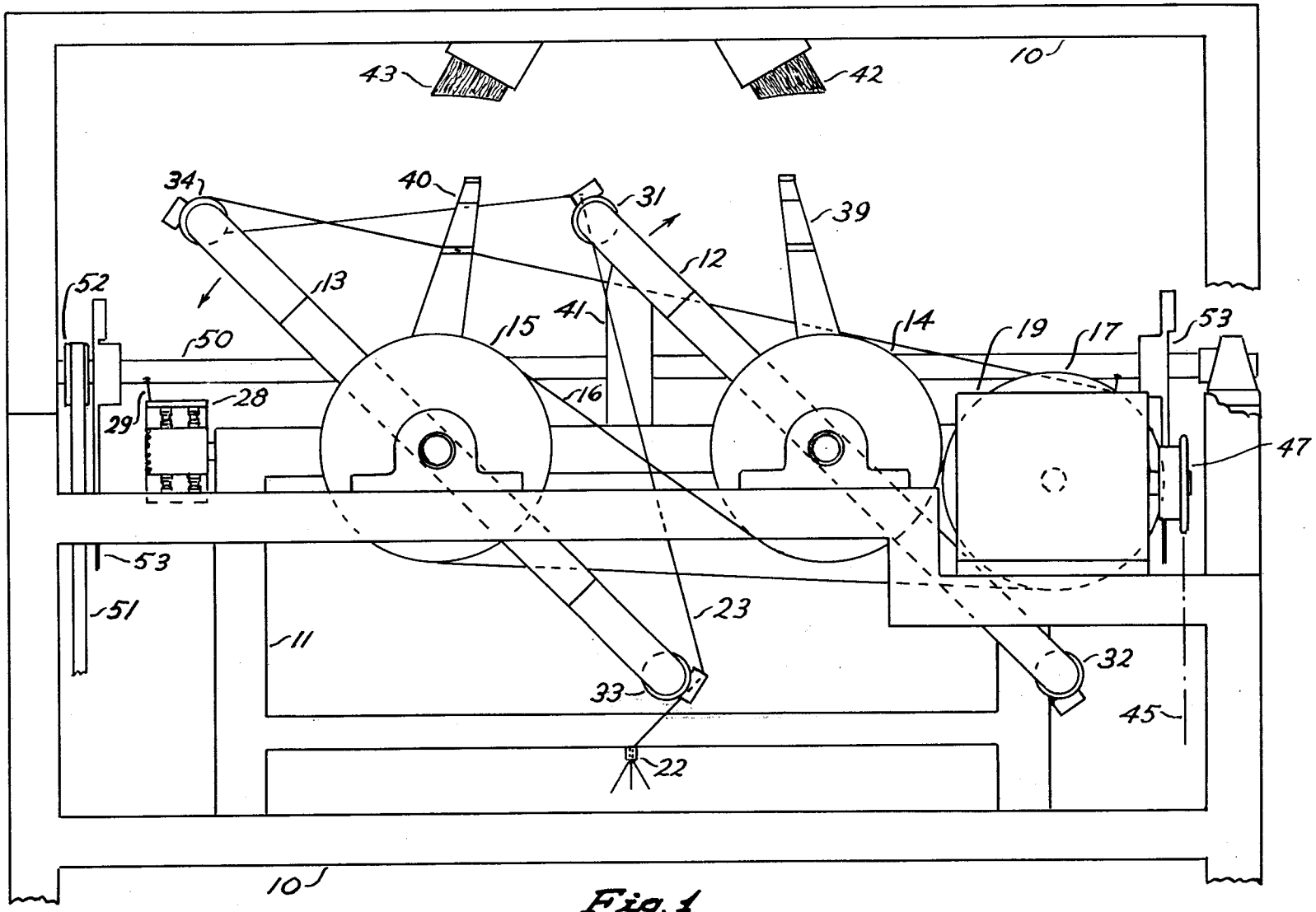
FIG. 1 is a front elevation of the apparatus for traversing strands according to the present invention.
Figure 2:
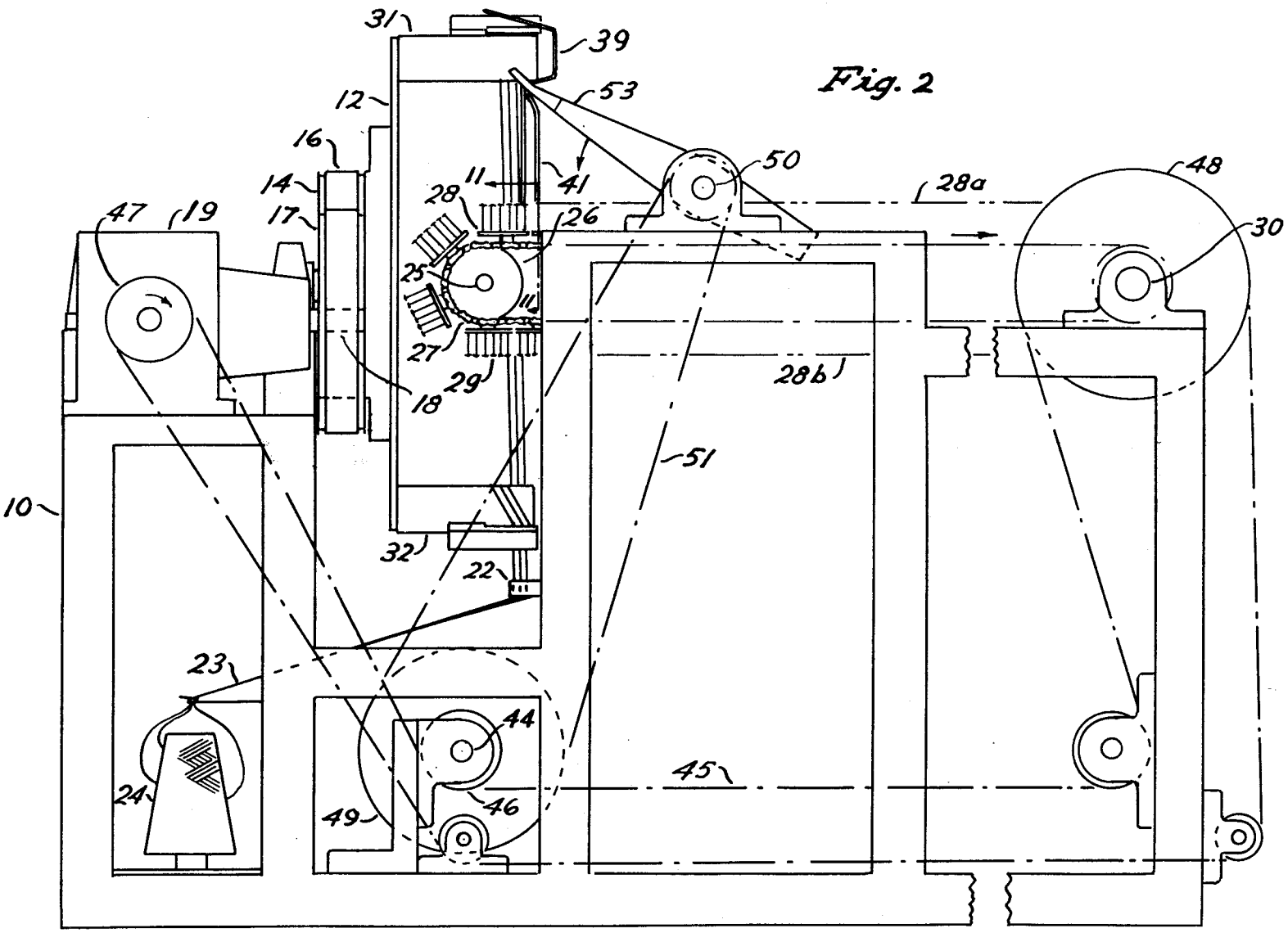
FIG. 2 is a partial side elevation of the apparatus shown in FIG. 1.
Figure 3:
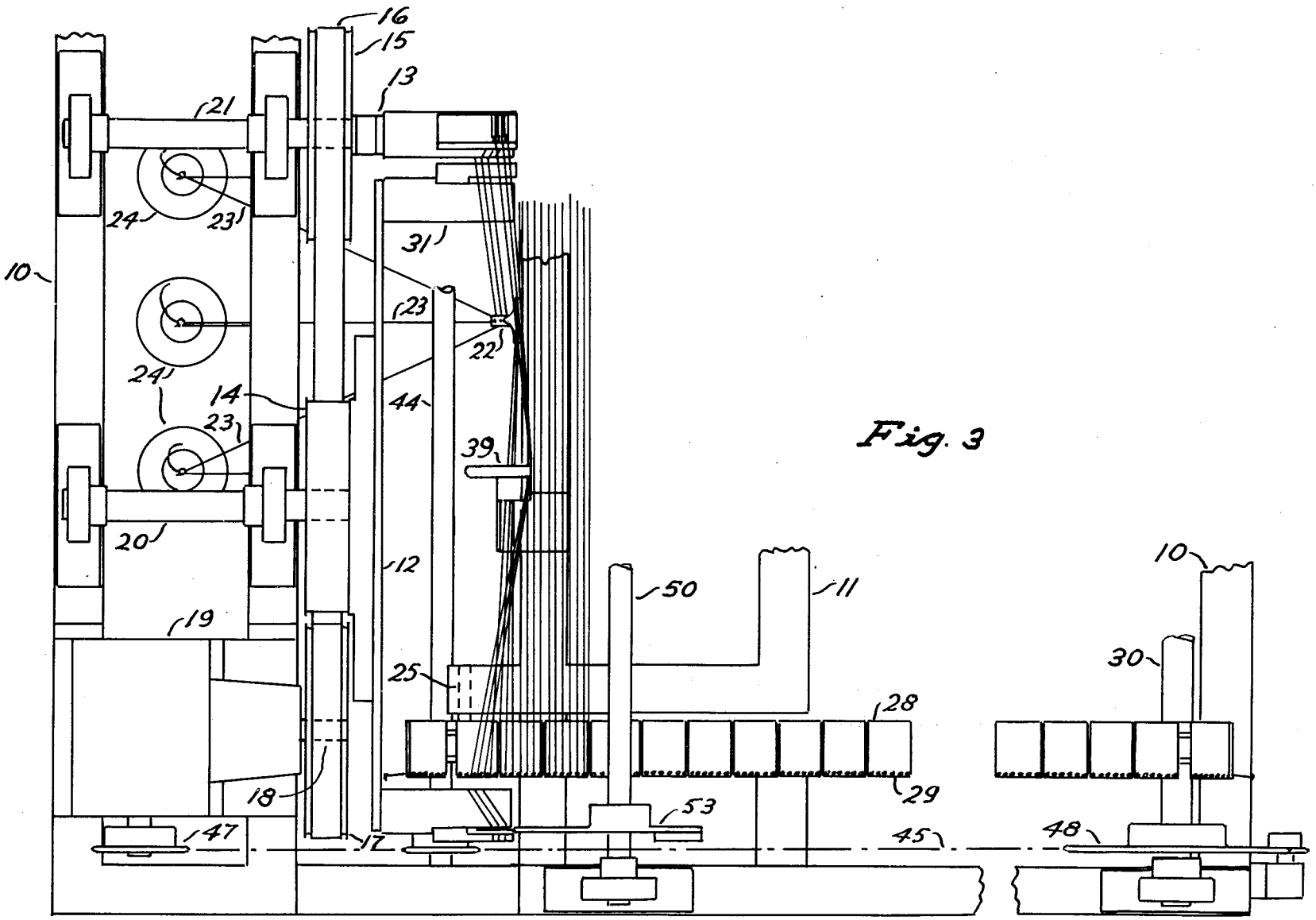
FIG. 3 is a partial top view of the apparatus shown in FIG. 1, but with members shown in a different rotational position.

Referring to FIGS. 1–3, a suitable framework is indicated comprising outer frame 10 and connected inner frame 11. Beams 12 and 13 are attached at their centers to timing pulleys 14 and 15, respectively, for counter-rotation in the directions of the arrows by timing belt 16 driven by timing pulley 17 on output shaft 18 of miter gear box 19 supported by outer frame 10. Timing pulleys 14 and 15 are mounted on respective shafts 20 and 21 running in bearings mounted on outer frame 10. Positioned at a lower level midway between shafts 20 and 21 is a guide 22 with a separate eyelet for each strand 23 coming from stationary supply packages 24. Guide 22 is attached to inner frame 11. The eyelets may be provided with slits for ease of threading.

Figure 11:
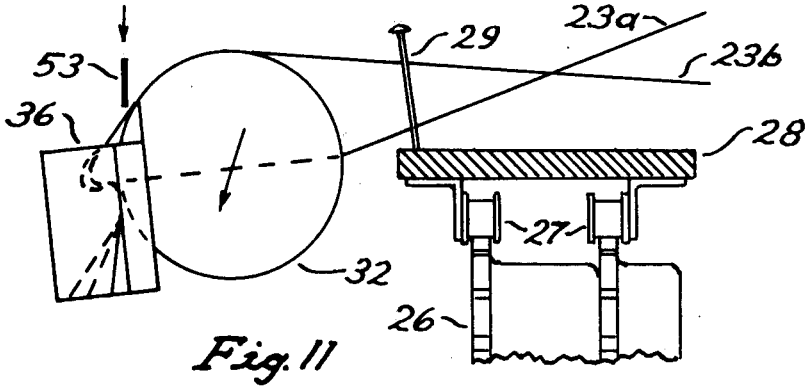
FIG. 11 is a section view taken along line 11—11 of FIG. 2 just prior to release of the strand loops.

Referring now to FIGS. 2 and 11, inner frame 11 has cantilevered portions that hold shaft 25 on the right side of the apparatus and a corresponding shaft on the opposite side. Sprockets 26 mounted for free rotation on shaft 25 hold chain 27 carrying conveyor 28 with a spaced row of pins 29 having rounded heads large enough to almost close the gaps between the pins. The conveyor has useful reach 28*a*, which defines the plane of the product web, and return reach 28*b*. Chain 27 is driven in the arrow direction by sprockets (not shown) on shaft 30 running in bearings attached to outer frame 10. Similar chain, sprockets, conveyor and spaced pins are provided on the opposite side of the apparatus and driven at the same speed by shaft 30. Beams 12 and 13 have respective cantilevered arms 31,32 and 33,34 at their extremities. These arms extend downstream relative to the conveyor and pass around (orbit) the cantilevered portion of the conveyor on the same side of the apparatus as the beam axis during beam rotation. These arms also pass close to guide 22 on the inside. The beams rotate 90° out of phase with each other.

Figure 9:
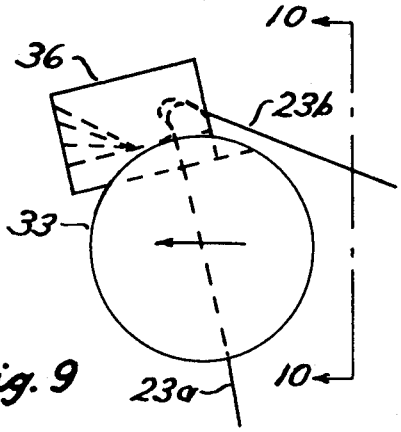
FIG. 9 is a front elevation of the orbiting extremity after 145 degrees of rotation beyond the position of FIG. 6.
Figure 10:
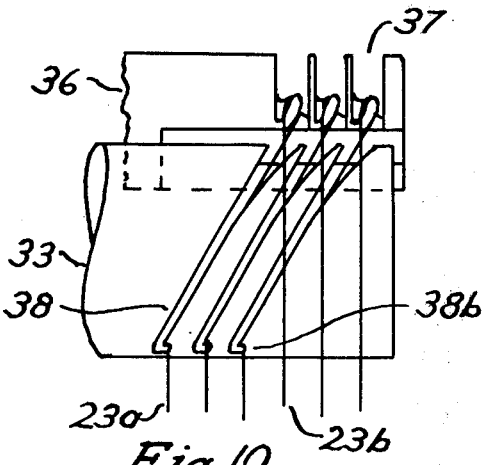
FIG. 10 is a view along 10—10 of FIG. 9.

With reference to FIGS. 4–10, arm 33 has a machined flat on its otherwise cylindrical surface. Fastened to this flat is hook bar 36 with slots 37 matching the positions of the eyelets of guide 22 as the arm passes the guide during rotation. Each slot is machined to form hook 37*a*. Hook bar 36 is shaped to provide a gap between it and arm 33 in the rigion of the slots. Arm 33 has angled tracks 38 in the form of narrow grooves cut half way through the arm. Each track has a dimensional projected component parallel to the orbited row. The end of each track closest to the hook bar is positioned opposite a slot. The track is angled from this point backward relative to the conveyor. As arm 33 reaches guide 22, a strand running to arm 31 is slideably engaged by sloping surface 37*b* of the matching slot and then, after further rotation, by the tapered entrance 38*a* of the corresponding track. This causes the strand to be deflected to the open side of the hook and then into the recess of the hook. The end of the track away from the hook bar has a side notch 38*b*. When the arm reaches the rotational position of FIG. 9, strand portion 23*a*, coming from guide 22, enters the track at the notch location and is pulled into the notch by strand tension. As long as tension is maintained on the strand it cannot escape from the notch until released from hook 37*a*. Strand portion 23*a*, during the approximate 145° rotation from the position of FIG. 6 to the position of FIG. 9 is pulled into the track because this is the shortest path going from guide 22 to hook 37*a*. When the arm is rotated from the position of FIG. 9 through an additional approximate 80° to a release position corresponding to FIG. 11, strand portion 23*b*, running from the hook to the opposite conveyor, wraps over the top of arm 33 instead of going into a track because this is its shortest path. As a consequence of 23*a* going into the angled track and 23*b* taking a route over the arm, the strand is formed into a loop having a component parallel to the conveyor and the portion of the strand last from the supply is rearmost relative to the conveyor. Arm 33, in passing part way around conveyor 28, moves strand portions 23*a* and 23*b* between different pins 29 on the conveyor. The loop of the strand is thereby positioned around a number of pins corresponding to the said loop component and is ready, upon release from hook 37*a*, to be pulled against the pins by arm 32 in opposite orbit. All arms are alike, except that arms in opposite orbits are mirror images of each other.

Figure 5:
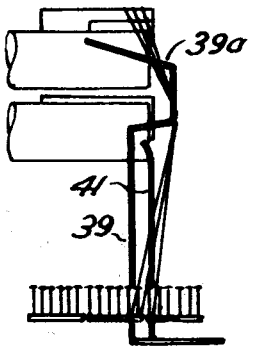
FIG. 5 is a view taken along 5—5 of FIG. 4.
Figure 4:
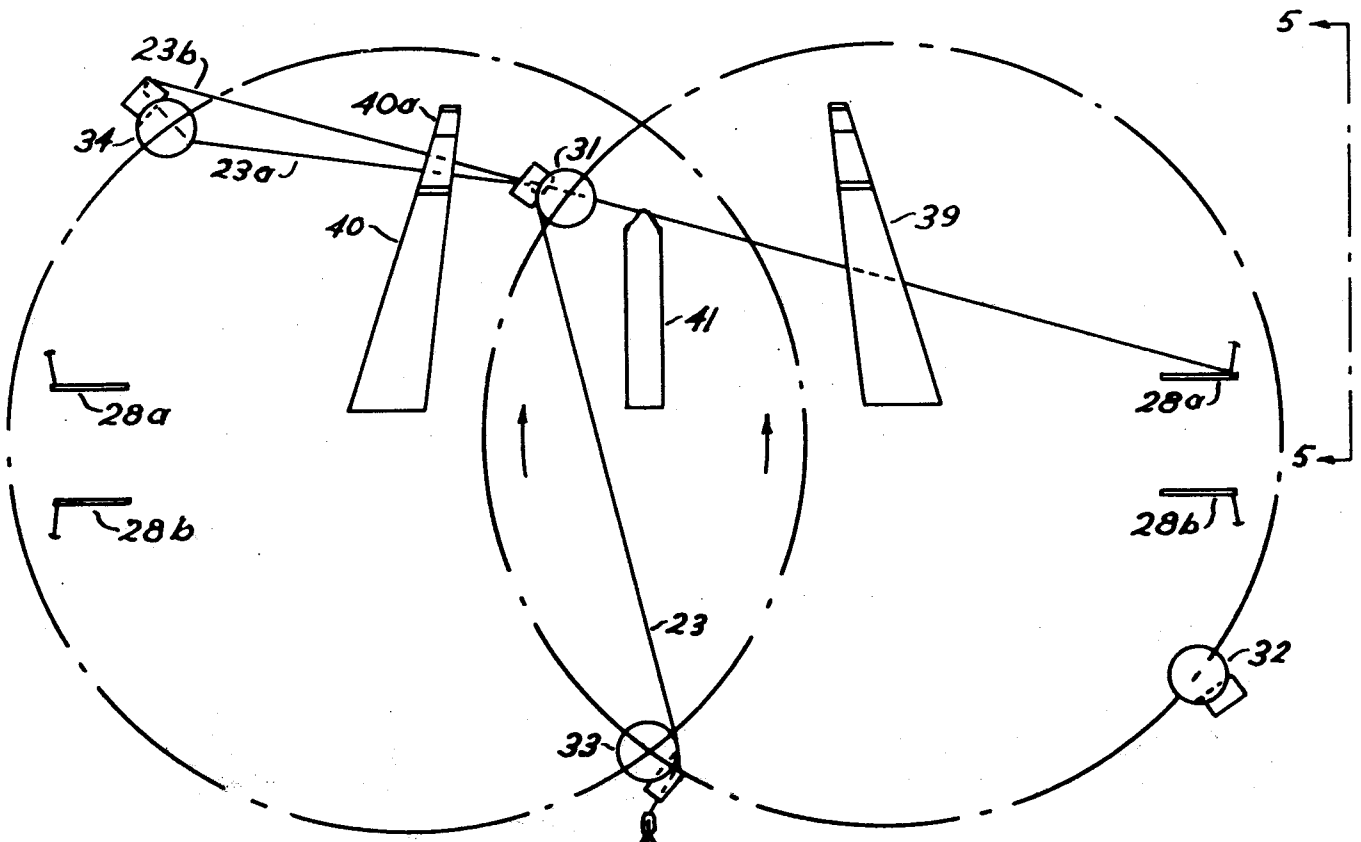
FIG. 4 is a front elevation, similar to FIG. 1, but with many parts removed to reveal strand paths.
Figure 6:
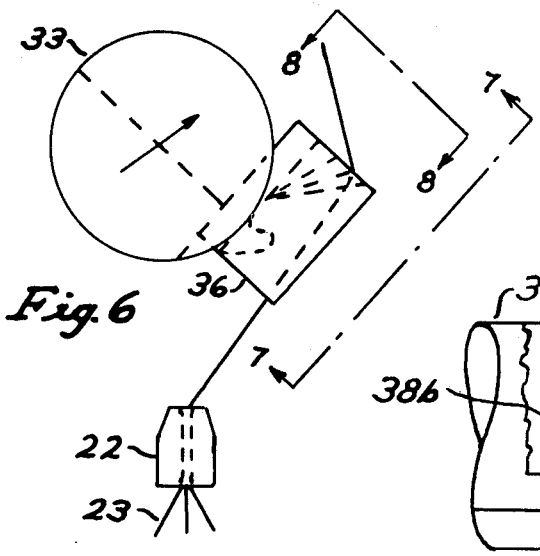
FIG. 6 is a front elevation showing the relationship between the orbiting, strand-engaging extremity and the strand shortly after engagement of the strand near the guide between the conveyors.
Figure 8:
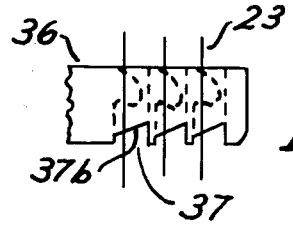
FIG. 8 is a view taken along 8—8 of FIG. 6.
Figure 7:
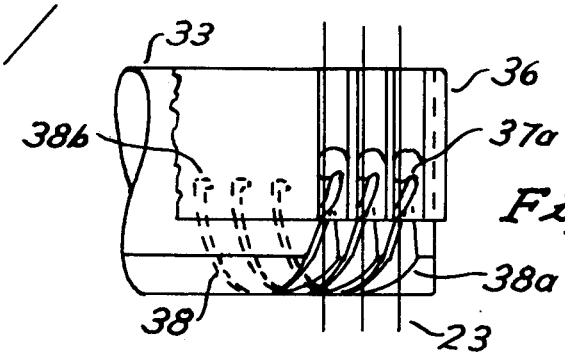
FIG. 7 is a view taken along 7—7 of FIG. 6.

With reference to FIGS. 4 and 5, arm 31 in clockwise orbit must pass strands running from the conveyor on the right side of the apparatus to arm 34 in counterclockwise orbit. The arms can be shaped to deflect the strands upon engagement. However, the preferred practice is to employ stationary deflectors 39 and 40 attached to inner frame 11. Arm 34 in passing above deflector 40 causes strand portions 23*a* and 23*b* to be pulled against inclined surface 40*a* of the deflector. Tension induced by the travel of arm 34 makes the strand portions slide down the incline to a position beyond the extreme downstream plane of arm travel. This enables arm 31 to pass the strands without contact. As the strands are moved down along the surface of the deflector by further travel of arm 34, they pass behind stationary guard 41 attached to inner frame 11 midway between the conveyors. This guard keeps the strands from getting in the path of arm 33. The strands, immediately after release to the conveyors, are angled downstream slightly around guard 41, but come free of the guard as the next set of strands is released to the conveyors. The small excess in strand length preferably is taken up by providing the conveyors with a short length of diverging travel at a convenient point downstream. Alternatively, the slight divergence can be immediate.

Upon release from arm 32, an instant after FIG. 11, the loop is pulled at once against pins 29 by arm 34 in opposite orbit. When the strand is in the form of a twist-lively yarn there is a tendency for the momentary loss of tension to permit the loop to escape the hook of the next arm in opposite orbit. This is prevented by fine bristle brushes 42 and 43 attached to an overhead component of outer frame 10. Numerous bristles are in the path of each hook slot 37 as the arm passes a brush at the instant of tension loss through loop release to the conveyor, the bristles sealing the opening of the slot against escape. Each brush is given a contour that matches one of the orbital paths to permit the possible duration of the sealing to be extensive. Experience has shown that this action, even with the most difficult strands, is not needed for more than a short interval beyond the instant of loop release. The bristles are angled in the direction of hook travel to preclude snagging.

With reference to FIGS. 1–3, all moving members of the apparatus are connected positively to drive shaft 44 which is driven by a power source, not shown. Chain 45 is driven by this shaft through sprocket 46. Chain 45, in turn, drives miter gear box 19 through sprocket 47 on the input shaft. This chain also drives shaft 30 through sprocket 48. A timing pulley 49 on shaft 44 drives shaft 50 through timing belt 51 and timing pulley 52. Shaft 50 is mounted in bearings on outer frame 10. It carries release blades 53 at each side of the machine for rotation in the indicated direction. The drive train gives the release blades from four to eight revolutions per rotation of beams 12 and 13, depending on the blade length, to provide the working end of each blade with a speed in excess of the peripheral speed of the orbiting arms. The blade on each side of the machine is synchronized and positioned to move downward against strand portion 23*b* when an orbiting arm reaches the position of FIG.11. The release blade does not engage the strand until the strand is positioned around the pins, as indicated. The release blade then, in moving downward through a gap between arm 32 and hook bar 36 and traveling at higher speed in the same general direction as hook bar 36, overtakes the strand and pushes it over the free end of hook 37*a* to effect the release.

Figure 12:
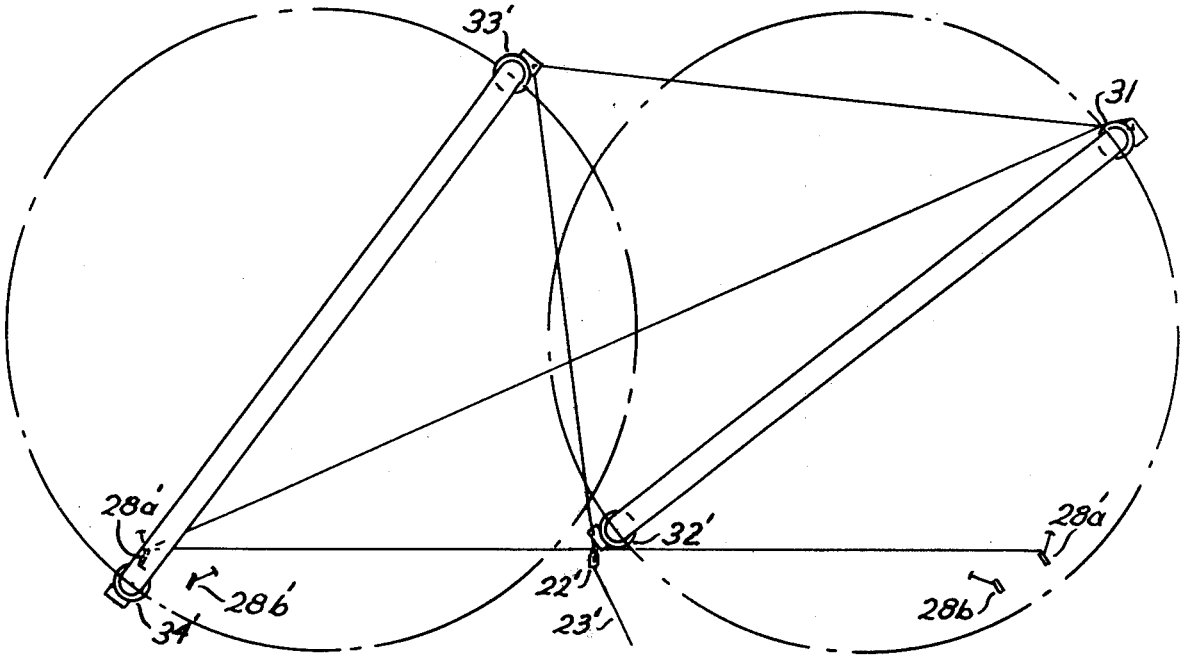
FIG. 12 is a schematic front elevation showing an alternative apparatus arrangement.

In the described, preferred, embodiment of the invention, guide 22 is below the plane of the conveyor, but the guide need not be limited to this position. FIG. 12 shows an alternative arrangement with guide 22' in the plane of conveyor 28'. Similar elements in the arrangement have been given the same numbers as in the preferred embodiment, only the numbers have been primed. This alternative arrangement will accomplish the same purpose but for most applications is less desirable because it requires longer beams with orbiting arms that have paths that extends well beyond the web width to require additional space.

Operation of the apparatus normally is started by threading each strand from the supply through the guide, around the corresponding hook on the nearest arm, through the track on the same arm to the conveyor on the side of the apparatus opposite the nearest arm, and securely around one or more pins on this conveyor. The apparatus is then put into motion with parts moving in the indicated diredtions. Each strand is then picked up by a hook on each arm as it passes the guide and is formed into a loop by the track as the strand is slideably carried to one of the conveyors and positioned around the desired number of pins. The release blade then discharges the strand to the pins. This progressive traversing of strands to opposite conveyors with each strand passing backward along the conveyor the desired distance before return results in webs having uniform strand patterns.

In the described embodiment, three strands are traversed simultaneously by the orbiting members, but many more can be handled by providing additional eyelets in guide 22 and additional tracks and hooks, respectively, in arms 31–34 and hook bars 36. With three strands being traversed, the orthogonal pattern of FIG. 13 is obtained when the following four conditions are met: one, the plane of the orbits is at right angle to the center line between the conveyors: two, track 38 is angled to provide a loop having a component parallel to the conveyor equal to three times the spacing of the eyelets plus an additional small increment to permit ease of placement; three, the conveyor travel per arm orbit of each beam equals six times the eyelet spacing; four, the conveyors are synchronized and the pin spacings arranged so that the last point of strand contact with a pin on one side of the apparatus is exactly opposite the first point of pin contact on the opposite conveyor.

Figure 13:
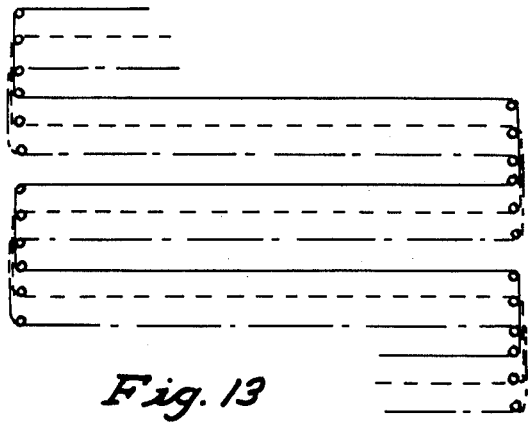
FIG. 13 shows a typical orthogonal pattern of a web with transverse strands restrained by two rows of pins.
Figure 14:
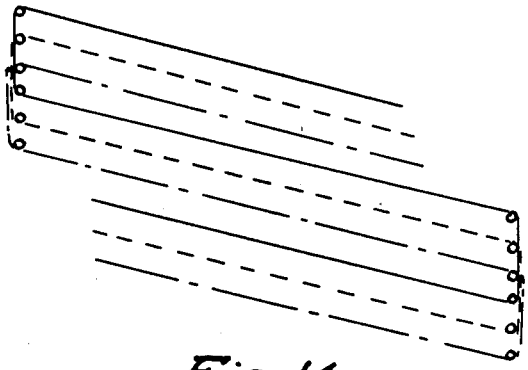
FIG. 14 shows a pattern similar to FIG. 13, except that the transverse strands are on a bias with relation to the rows.

The pattern of FIG. 14 can be obtained by having the plane of orbit on a bias with the direction of conveyor travel and observing the other conditions required for the pattern of FIG. 13, except that the opposite pin spacings are arranged to comply with the bias.

Patterns similar to FIGS. 13 and 14 can be obtained with other number of strands, provided that the loop component parallel to the conveyor is equal to the eyelet spacing multiplied by the number of strands and the conveyor travel is proportional.

Figure 15:
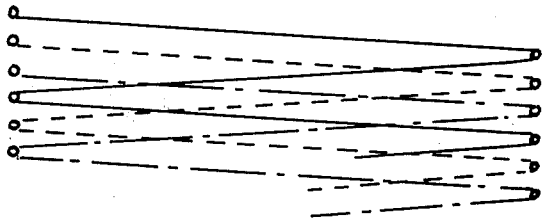
FIG. 15 shows a diamond pattern with crossing traverses restrained by a single pin at each strand reversal.

The pattern of FIG. 15 can be obtained by employing opposite conveyors with staggered pin placements and giving track 38 a component parallel to the conveyor large enough to encompass one pin but not two pins.

The preferred pins 29 have heads that are smooth and rounded on top. If the gap between adjacent pin heads in a row is great enough to permit passage of the strand, the orbital positioning is sufficeintly positive to move the strand past the heads and the placement will be correct as long as the strand is brought down in the proper space defined by pin centers. The headed pins have an advantage over other pins in the security of strand restraint. Preferably they are inclined outward to induce the strands to be pulled to the conveyor surface. Pointed or blunt pins can also be employed. Other types of strand-restraining elements, such as notches in the edge of the conveyor, likewise, can be made to serve.

The simple rotary motions employed in this invention permit high strand speed. The orbiting of the conveyors provides positive placement without the risk of strand damage associated with transverse deposits. The discharge of the loops to the conveyors is made with releasing blades traveling in the same general, instantaneous direction as the loops for ease of strand treatment. The orbiting members go only a short distance outside the web width to minimize space requirements.

The above detailed description of the preferred embodiment of the invention has been given for comprehension of the inventive concept and should not be construed to indicate limitations. The illustrated product patterns will suggest others to one skilled in the art. The restrained webs formed by the apparatus and method of the invention may be employed for any purpose described in the prior art for webs having transverse strands.

What is claimed is:

1. An apparatus for traversing a strand between two spaced rows of strand-restraining elements moving together in the same approximate direction to form a web, said apparatus comprising:

a strand supply source;

a guide between said rows for receiving the strand from said supply source;

a strand-engaging member orbiting each row of strand-restraining elements for slideably engaging the strand near said guide and traversing said strand toward one and then the other row while forming a loop during each traverse and positioning the loop around at least one of said strand-restraining elements; and means for releasing said loop from said strand-engaging member.

2. The apparatus of claim 1, said strand-engaging member having a track that forms said loop by means of said orbiting.

3. The apparatus of claim 1, said strand-engaging member having a hook and a loop-forming track.

4. The apparatus of claim 3, said hook having the opening sealed during part of said orbiting to preclude strand escape.

5. The apparatus of claim 1, said means for releasing said loop being a blade outboard of each row and synchronously rotated with respect to said orbiting and traveling in the same approximate direction as the strand-engaging member during the release.

6. The apparatus of claim 1, said strand-engaging member having a hook and a loop-forming track, said means for releasing said loop being blade located outboard of each row and synchronously rotated with respect to said orbiting and traveling between said hook and said loop-forming track.

7. The apparatus of claim 1, said traversing including movement of said strand around an oppposite orbiting strand-engaging member by means of a deflector.

8. The apparatus of claim 1, said guide having a plurality of eyelets, each of said strand-engaging members having hooks with the same spacings as the eyelets and loop-forming tracks with matching spacings.

9. The apparatus of claim 1, said strand-engaging member being an arm at the extremity of a rotated beam, said arm being cantilevered downstream relative to said movement of strand-restraining elements.

10. An apparatus for traversing a plurality of strands between two spaced rows of strand-restraining elements moving together in the same approximate direction to form a web, said apparatus comprising:

a strand supply source;

a guide between said rows for receiving strands from said supply source, said guide having at equal spacings a separate eyelet for each strand;

a strand-engaging member orbiting each row of strand-restraining elements for slideably engaging the strands near said guide and traversing said strands toward one and then the other row while forming a loop in each strand and positioning each loop around a different set of strand-restraining elements, each of said loops having a component parallel to said orbited row at least as large as the spacings of the eyelets multiplied by the number of strands in said plurality; and means for releasing said loops from said strand-engaging member.

11. A method for traversing a strand between spaced rows of strand-restraining elements moving together in the same direction to form a web, each traverse comprising:

feeding the strand from a stationary supply to a location between the rows of strand-restraining elements, and thence over an orbital path encompassing one of the rows;

engaging the strand near said location and moving the strand in an orbital path partially around the other row of strand-restraining elements, said movement forming a loop in the strand and positioning the loop around at least one strand-restraining element; and releasing said strand to said strand-restraining element 12. The method as defined in claim 11, said orbital paths being orthogonal with respect to said rows.

13. The method as defined in claim 11, said orbital paths being on a bias with respect to said rows.

14. A method for traversing a strand between spaced rows of a strand-restraining elements moving together in the same direction to form a web, each traverse comprising:

moving the strand from a location between said rows as a loop in an orbital path partially around one of said rows whereby said movement draws the strand from a stationary supply through said location and positions the loop around at least one of said strand-restraining elements; and releasing said loop to said strand-restraining element.

15. The method as defined in claim 14, said orbital path being orthogonal with respect to said rows.

16. In a method of traversing a strand between two spaced rows of strand-restraining elements moving together in the same direction to form a web, wherein said strand is fed from a stationary supply to a location between the rows and thence towards one row and is then traversed in a plane transverse to the plane of the strand-restraining elements toward the other row, a loop being formed in the strand during each traverse;

The improvement comprising: carrying the loop partially around said other row to position the loop around at least one of said strand-restraining elements; and releasing said loop to said strand-restraining element.

17. An apparatus for traversing a strand between two spaced rows of strand-restraining elements moving together in the same approximate direction to form a web, said apparatus comprising:

a strand supply source;

a guide between said rows for receiving the strand from said supply source;

a strand-engaging member orbiting each row of strand-restraining elements for slideably engaging the strand near said guide and traversing said strand toward one and then the other row while forming a loop during each traverse and positioning the loop around at least one strand-restraining element with a gap between adjacent elements just great enough to permit passage of the strand; and means for releasing said loop from said strand-engaging member.

18. A method for traversing a strand between two spaced rows of strand-restraining elements moving together in the same approximate direction to form a web, each traverse comprising:

feeding the strand from a supply to a location between the rows of strand-restraining elements, and thence over an orbital path encompassing one of the rows;

engaging the strand near said location and moving the strand in an orbital path partially around the other row of strand-restraining elements, said movement forming a loop in the strand and positioning the loop around at least one strand-restraining element with a gap between adjacent elements just great enough to permit passage of the strand; and releasing said strand to said strand-restraining element.

19. An apparatus for traversing a strand between two spaced rows of strand-restraining elements moving together in the same approximate direction to form a web, said apparatus comprising:

a strand supply source;

a guide between said rows for receiving the strand from said supply source;

a strand-engaging member orbiting each row of strand-restraining elements for slideably engaging the strand near said guide and traversing said strand toward one and then the other row while forming a loop during each traverse and positioning the loop around at least one of said strand-restraining elements whereby said strand is positioned orthogonal between said rows; and means for releasing said loop from said strand-engaging member.

20. A method for traversing a strand between two spaced rows of strand-restraining elements moving together in the same approximate direction to form a web, each traverse comprising:

feeding the strand from a supply to a location between the rows of strand-restraining elements, and thence over an orbital path encompassing one of the rows;

engaging the strand near said location and moving the strand in an orbital path partially around the other row of strand-restraining elements, said movement forming a loop in the strand and positioning the loop around at least one strand-restraining element whereby said strand is positioned orthogonal between said rows; and releasing said strand to said strand-restraining element.

21. The method as defined in claim 20, said orbital paths being counter-rotational.

22. A method for traversing a strand between two spaced rows of strand-restraining elements moving together in the same approximate direction to form a web, said method comprising:

moving the strand from a location between said rows as loops in orbits of opposite rotation that each encompasses one of said rows, each of said orbital movements drawing the strand from a supply through said location, forming the strand into one of said loops and positioning said one loop around at least one of said strand-restraining elements; and releasing said loops to said strand-restraining elements.

23. An apparatus for traversing a plurality of strands simultaneously between two spaced rows of strand-restraining elements moving together in the same approximate direction to form a web, said apparatus comprising:

a source of supply strands;

a guide between said rows for separately receiving each strand from said source;

a strand-engaging member orbiting each row of strand-restraining elements for slideably engaging the strands near guide and traversing said strands toward one and then the other row while forming a loop in each strand during each traverse and positioning each loop around at least one of said strand-restraining elements; and means for releasing the loops from said strand-restraining member.

24. A method for traversing a plurality of strands simultaneously between two spaced rows of strand-restraining elements moving together in the same approximate direction to form a web, said method comprising:

feeding a plurality of strands from a stationary supply to a location between the rows of strand-restraining elements, and thence over orbital paths encompassing one of the rows;

engaging said strands near said location and moving the strands in orbital paths partially around the other row of strand-restraining elements, each of said orbital movements forming a loop in each strand and positioning each loop around at least one of said strand-restraining elements; and releasing the loops to said strand-restraining elements.

* * * * *